US007284400B1

(12) United States Patent
Agozzino

(10) Patent No.: US 7,284,400 B1
(45) Date of Patent: Oct. 23, 2007

(54) DEADBOLT LOCK KNOB IMMOBILIZER

(76) Inventor: Andrew Agozzino, 7202 NW. 89th Ave., Tamarac, FL (US) 33321

( * ) Notice: Subject to any disclaimer, the term of this patent is extended or adjusted under 35 U.S.C. 154(b) by 0 days.

(21) Appl. No.: 11/633,364

(22) Filed: Dec. 4, 2006

Related U.S. Application Data

(60) Provisional application No. 60/764,638, filed on Feb. 2, 2006.

(51) Int. Cl.
*E05B 13/00* (2006.01)

(52) U.S. Cl. ..... 70/416; 70/430

(58) Field of Classification Search ..... 70/416, 70/429, 430
See application file for complete search history.

(56) References Cited

U.S. PATENT DOCUMENTS

| | | | | | |
|---|---|---|---|---|---|
| 2,463,195 | A | * | 3/1949 | Mungan | 70/416 |
| 3,585,827 | A | * | 6/1971 | Dominguez | 70/416 |
| 3,862,556 | A | * | 1/1975 | Moses | 70/416 |
| 3,933,014 | A | * | 1/1976 | Moses | 70/416 |
| 4,185,483 | A | * | 1/1980 | Lupton et al. | 70/416 |
| 4,279,137 | A | * | 7/1981 | Cook | 70/416 |
| 4,715,200 | A | * | 12/1987 | Katsaros | 70/211 |
| 5,000,498 | A | | 3/1991 | Upchurch | |
| 5,007,263 | A | * | 4/1991 | Taylor | 70/416 |
| 5,035,128 | A | * | 7/1991 | Ridgway | 70/211 |
| 5,052,202 | A | * | 10/1991 | Murphy | 70/211 |
| 5,230,230 | A | | 7/1993 | Horton | |
| 5,325,685 | A | | 7/1994 | Frank | |
| 5,462,322 | A | | 10/1995 | Berezansky | |
| 5,515,704 | A | | 5/1996 | van Nguyen | |
| 5,865,050 | A | | 2/1999 | Michaud | |
| 6,324,879 | B1 | | 12/2001 | Kennedy | |
| 6,332,344 | B1 | | 12/2001 | Montoya | |
| 6,742,369 | B1 | | 6/2004 | Veillette | |
| 6,993,944 | B2 | * | 2/2006 | Hicks | 70/416 |
| 2005/0193787 | A1 | * | 9/2005 | Davis | 70/416 |
| 2007/0033973 | A1 | * | 2/2007 | Kosi | 70/416 |

* cited by examiner

*Primary Examiner*—Suzanne Dino Barrett
(74) *Attorney, Agent, or Firm*—Alvin S. Blum

(57) ABSTRACT

Apparatus is simply hung on a deadbolt knob when the deadbolt is in locked position. It prevents the deadbolt knob from rotating enough to retract the deadbolt. This ensures that the door cannot be unlocked from the outside. A passage in an upper end of the apparatus is dimensioned to receive the deadbolt knob. The deadbolt knob is not round. The passage has side walls narrow enough to prevent the deadbolt knob from rotating freely within the passage. As the knob is rotated, the knob engages the side walls of the passage so that the entire apparatus rotates until the lower end of the apparatus engages a fixed element that prevents further rotation of the knob. That fixed element is either the doorjamb or the doorknob. This immobilizes the knob and deadbolt.

5 Claims, 4 Drawing Sheets

DEADBOLT LOCK KNOB IMMOBILIZER

Applicant claims the benefit of provisional patent application No. 60/764,638 filed Feb. 2, 2006 incorporated herein by reference in its entirety.

FIELD OF THE INVENTION

This invention relates generally to door locking mechanisms, and more specifically to a portable, easily installable and removable door locking device that prevents operation of the deadbolt lock mechanism.

BACKGROUND OF THE INVENTION

It is well known in the art to provide a door with a deadbolt lock. Such locks are generally provided where security is a concern, such as the door of a home, business, or hotel room. The lock is operable by key on the outside. It may be operable without a key on the inside by a simple knob. This enables escape in an emergency without a key. The knob is elliptical in shape so that a user can visually determine whether the deadbolt is locked or unlocked. The long axis of the ellipse is generally vertical when the bolt is in the locked position. When a person is secure behind a deadbolt locked door, that security may be breached by someone with a key, or someone with means to retract the bolt. It would be useful to provide means to further ensure that someone with a key or such means could not unlock the door.

SUMMARY OF THE INVENTION

In accordance with an aspect of the invention, a device is provided that can be simply hung on the deadbolt knob that will prevent the knob and the bolt connected thereto from operating. A first end of the device has a passage to receive the deadbolt knob. As the knob is rotated, the device is so shaped and dimensioned that it also is rotated, until a portion of the device is forced against a rigid element that prevents further rotation. That element may be a door jamb or a knob. The device may be provided with means for storing in an inactive mode at the door, so that it is readily available when needed.

These and other objects, features, and advantages of the invention will become more apparent from the detailed description of an exemplary embodiment thereof as illustrated in the accompanying drawings, in which like elements are designated by like reference characters in the various drawing figures.

DETAILED DESCRIPTION OF PREFERRED EMBODIMENTS

Figure 1:
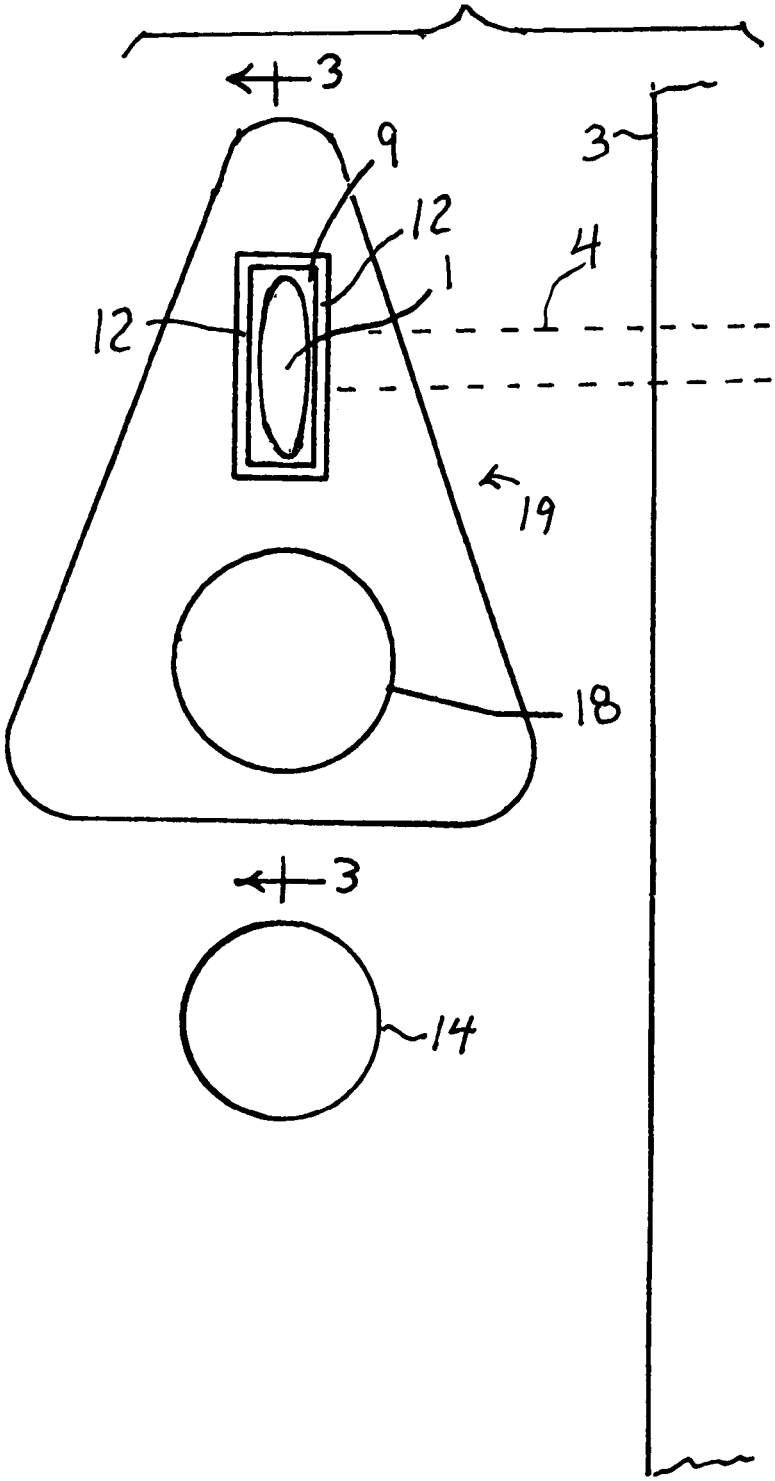
FIG. 1 is a front elevation view of the invention in use.
Figure 2:
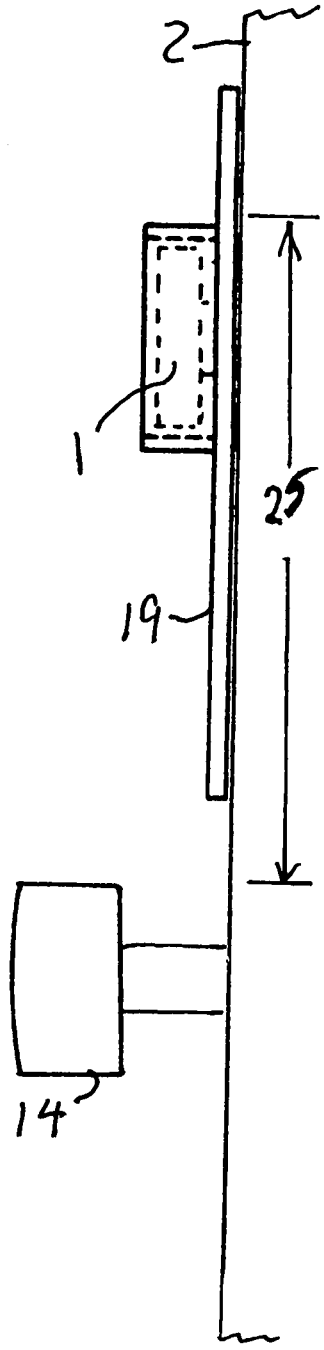
FIG. 2 is a side view of the device of FIG. 1.
Figure 4:
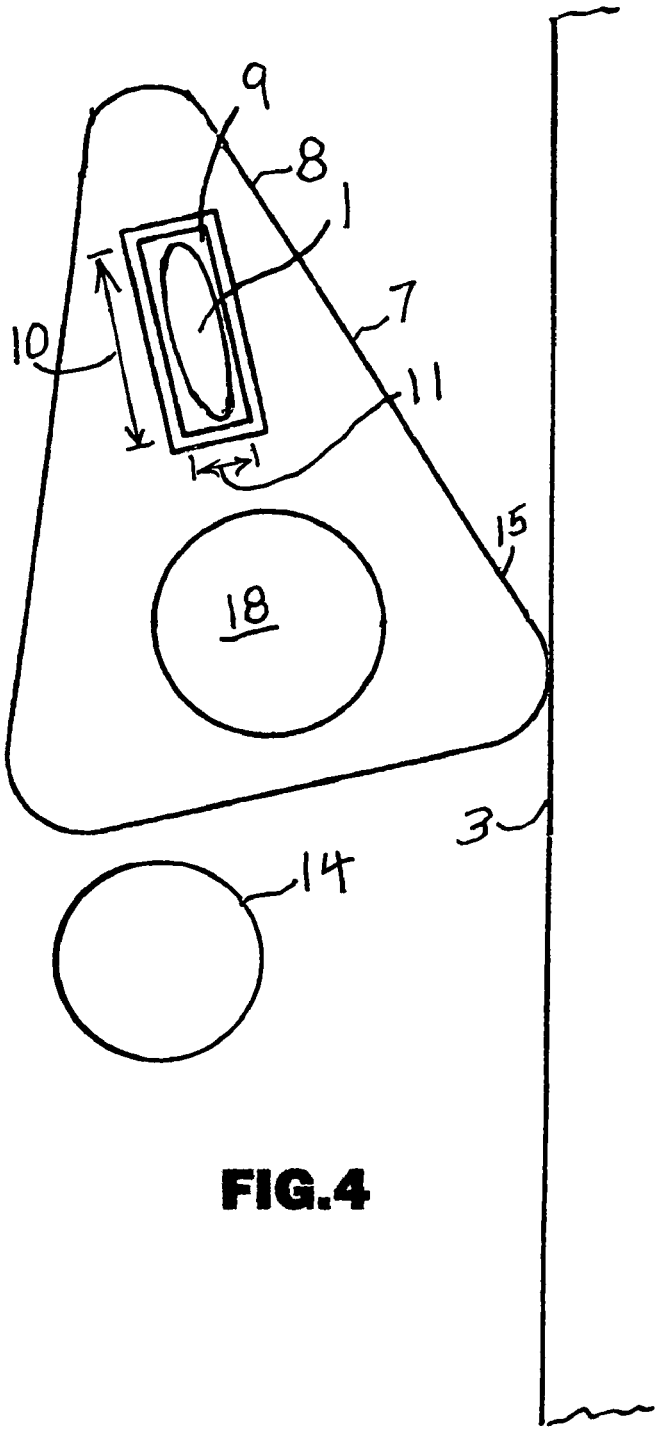
FIG. 4 is a front elevation view of the invention blocking the retraction of the deadbolt.
Figure 3:
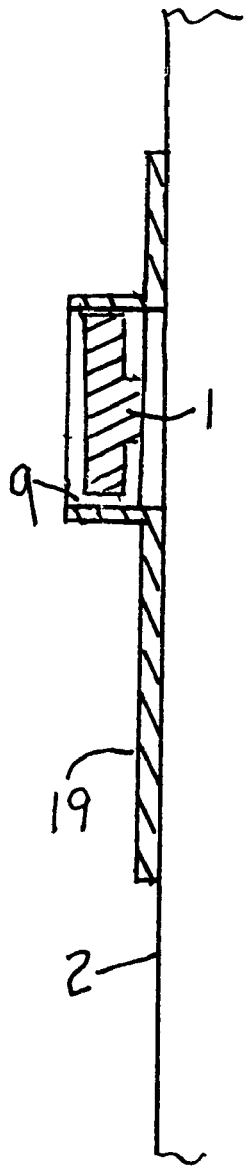
FIG. 3 is a sectional view taken through line 3-3 of FIG. 1.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not limitation.

Referring now first to drawing FIGS. 1-5, a conventional door 2 mounted in a frame 3 has a doorknob 14 and a deadbolt 4 (shown in phantom) that is operated by rotation of a key (not shown) on one side of the door and/or a deadbolt knob 1 on the other side of the door. The deadbolt knob 1 and the doorknob 14 are spaced apart by a first distance 25. The deadbolt knob 1 is operationally linked to the deadbolt, so that the deadbolt cannot move if the knob 1 is prevented from rotating. A deadbolt knob immobilizing apparatus 19 of the invention may be removably mounted on the deadbolt knob 1 so as to prevent rotation of the knob and also of the deadbolt to which it is linked. This ensues that the deadbolt cannot be retracted (unlocked) by a key on the outside, or by an intruder with burglary tools. The apparatus 19 of the invention comprises an elongate body 7 with a through passage 9 at a first end 8. The passage is constructed and dimensioned to readily receive the deadbolt knob 1 therein. Deadbolt knobs 1 have a long first dimension 5, and a shorter second dimension 6 orthogonal to the first dimension. The passage 9 has side walls 12 that are spaced apart a greater distance 11 than the second dimension 6 of the knob 1 and a lesser dimension than the first dimension 5 of the knob 1 so that the knob 1 cannot rotate freely within the passage. When the knob 1 is rotated, the second end 15 of the body is rotated until it engages the fixed jamb of door frame 3. This immobilizes the deadbolt knob, preventing further rotation of knob 1 and retraction of deadbolt 4. For convenience of storage of the apparatus when not operational, an aperture 18 is provided in the second end 15. This is dimensioned to slip over the doorknob 14. When hanging there, it does not interfere with door operation.

Figure 6:
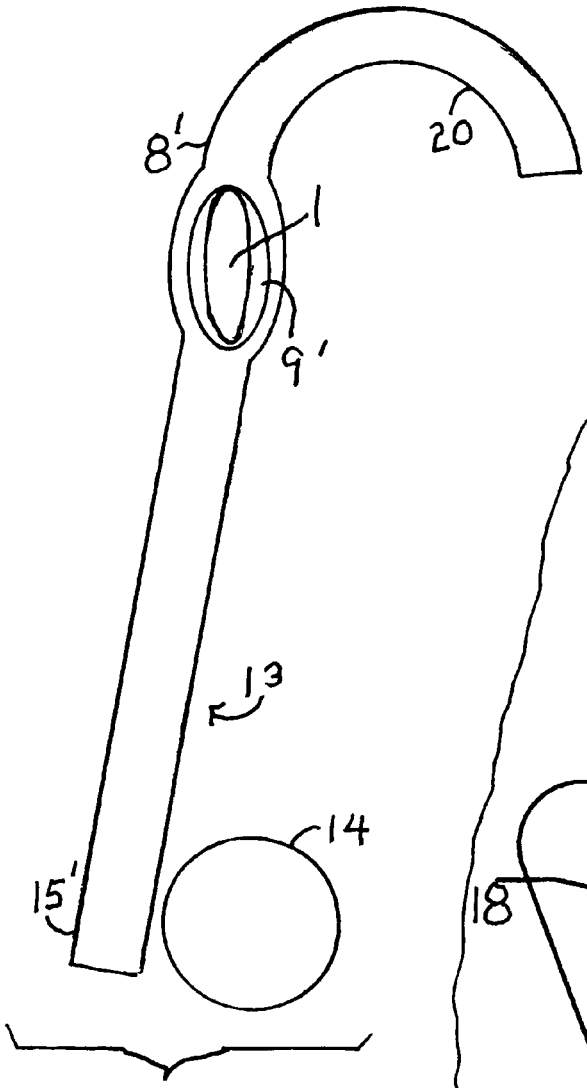
FIG. 6 is a front elevation view of another embodiment of the invention in use
Figure 5:
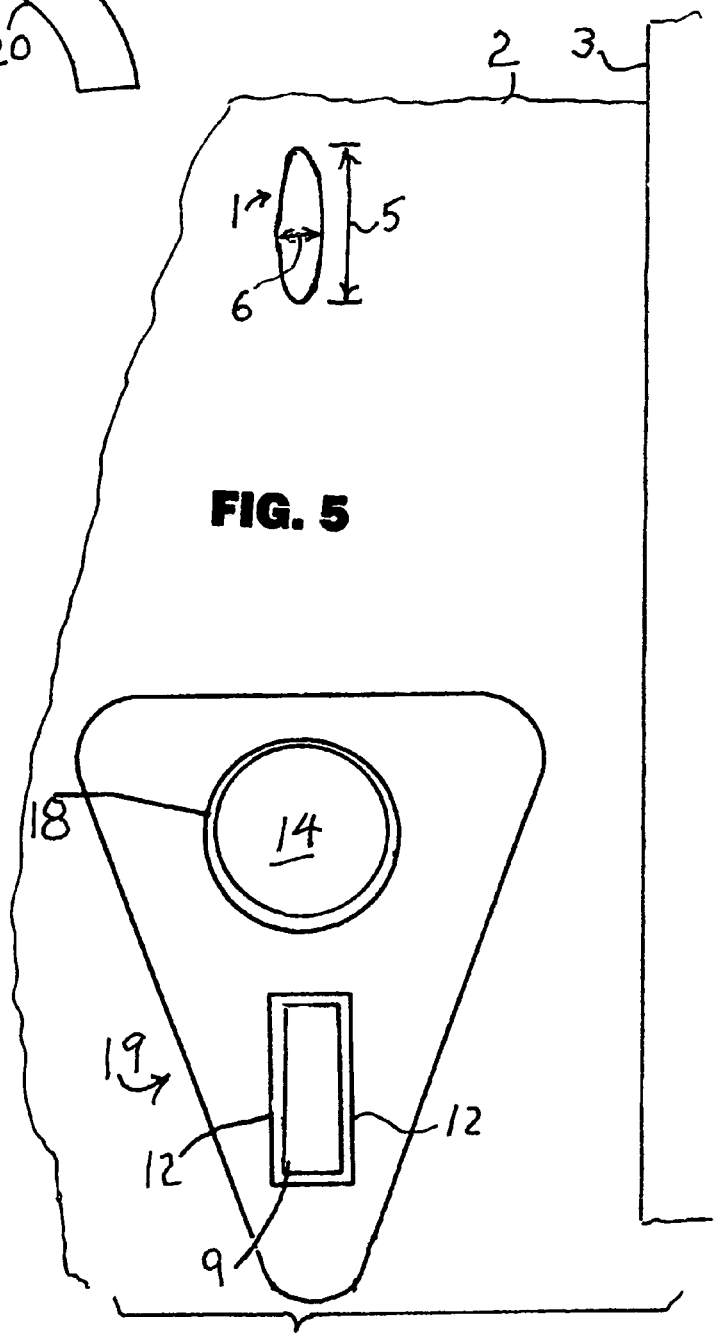
FIG. 5 is a front elevation of the device in storage mode.

Referring now to FIG. 6, another embodiment 13 of the invention is shown. It has a passage 9' at a first end 8' dimensioned to receive the deadbolt knob 1 therein and prevent free rotation therein as described above. The elongate second end 15' is long enough to reach the fixed element of doorknob 14 as the knob 1 is rotated, thereby immobilizing and preventing further rotation of the deadbolt knob. A hook 20 is provided for hanging on the doorknob when not in use. There it will be readily available and will not interfere with door operation.

Figure 7:
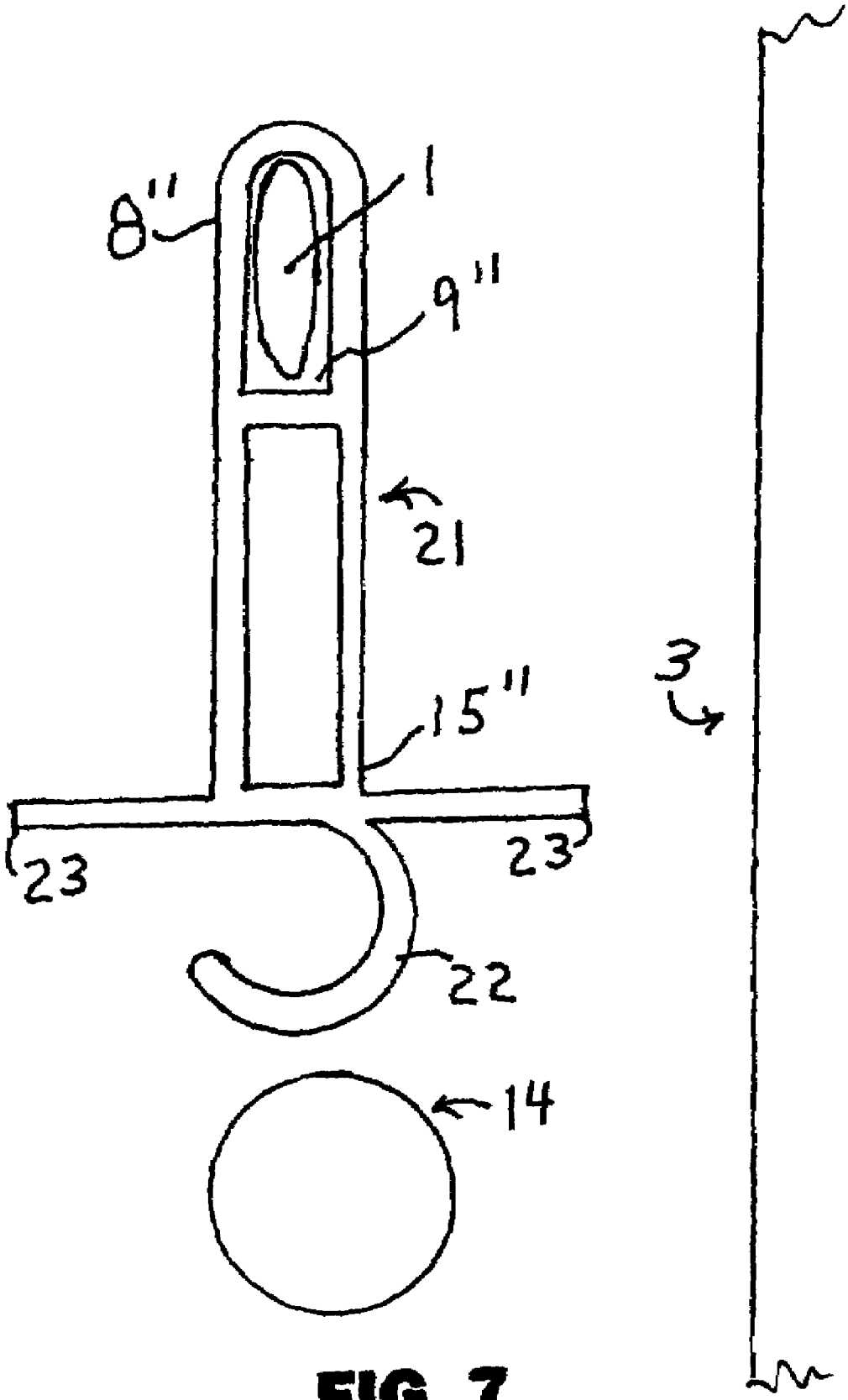
FIG. 7 is a front elevation view of another embodiment of the invention

Referring now to FIG. 7, another embodiment 21 of the invention is shown. It has a passage 9" at a first end 8" dimensioned to receive the deadbolt knob 1 therein and prevent free rotation therein as described above. Extensions 23 at second end 15" will engage the fixed door frame 3 before the deadbolt will be unlocked. A hook 22 provides a means for storing the device on the doorknob when not in use. The apparatus of FIGS. 6 and 7 may be of uniform thickness through out for ease of manufacture by profile extrusion or injection molding, for example.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. Apparatus to prevent rotation of a deadbolt knob on a door mounted in a door frame to thereby prevent movement of a deadbolt connected to the deadbolt knob from a locked position, the deadbolt knob having a long first dimension and a shorter second dimension orthogonal to the first dimension, the apparatus comprising:

a) an elongate body having a long axis and no moving parts;

b) a through passage at a first end of the body, the passage constructed and dimensioned to removably receive the deadbolt knob therein and having parallel side walls disposed on either side of the long axis that are spaced apart a greater distance than the second dimension and a lesser distance than the first dimension so that the deadbolt knob cannot rotate freely within the passage; and c) a second end of the body having a greater width than the first end constructed and dimensioned to engage the door frame as the deadbolt knob is rotated to prevent sufficient rotation of the deadbolt knob to unlock the deadbolt; and d) rigid hanging means on the second end for hanging the apparatus on a doorknob for storage when not in use, and the hanging means not interfering with door operation.

2. Apparatus to prevent rotation of a deadbolt knob on a door mounted in a door frame, the door having a door knob spaced apart a first distance from the deadbolt knob, to thereby prevent movement of a deadbolt connected to the deadbolt knob from a locked position, the knob having a long first dimension and a shorter second dimension orthogonal to the first dimension, the apparatus comprising:

a) an elongate body having a long central axis that is less than said first distance;

b) a passage at a first end of the body, the passage constructed and dimensioned to removably receive the deadbolt knob therein and having side walls disposed on either side of the central axis that are spaced apart a greater distance than the second dimension and a lesser distance than the first dimension so that the deadbolt knob cannot rotate freely within the passage; and c) a second end of the body having a greater width than the first end constructed and dimensioned to engage the door frame as the deadbolt knob is rotated to prevent sufficient rotation of the deadbolt knob to unlock the deadbolt.

3. The apparatus of claim 2 further comprising:

hanging means on the second end for hanging the apparatus on a doorknob for storage when not in use, and the hanging means not interfering with door operation.

4. Apparatus to prevent rotation of a deadbolt knob on a door pivotally mounted in a door frame and having a door knob spaced apart from the deadbolt knob by a first distance to thereby prevent movement of a deadbolt connected to the deadbolt knob from a locked position, the deadbolt knob having a long first dimension and a shorter second dimension orthogonal to the first dimension, the apparatus comprising:

a) an elongate body having a length less than said first distance;

b) a passage at a first end of the body, the passage constructed and dimensioned to removably receive the deadbolt knob therein and having side walls that are spaced apart a greater distance than the second dimension and a lesser distance than the first dimension so that the deadbolt knob cannot rotate freely within the passage; and c) a second end of the body constructed and dimensioned to engage the door frame as the deadbolt knob is rotated to prevent sufficient rotation of the deadbolt knob to unlock the deadbolt.

5. The apparatus of claim 4 further comprising:

hanging means on the second end for hanging the apparatus on a doorknob for storage when not in use, and the hanging means not interfering with door operation.

* * * * *